US011702317B2

(12) United States Patent
Shi et al.

(10) Patent No.: US 11,702,317 B2
(45) Date of Patent: Jul. 18, 2023

(54) FORCE APPLICATION ASSEMBLY, ELEVATOR AND METHOD OF ELEVATOR RESCUE

(71) Applicant: Otis Elevator Company, Farmington, CT (US)

(72) Inventors: Yunkang Shi, Shanghai (CN); Zhenyan Tong, Shanghai (CN); Wei Wang, Shanghai (CN); Min Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 48 days.

(21) Appl. No.: 17/390,381

(22) Filed: Jul. 30, 2021

(65) Prior Publication Data

US 2022/0169481 A1 Jun. 2, 2022

(30) Foreign Application Priority Data

Nov. 30, 2020 (CN) ..... 202011370900.7

(51) Int. Cl.
*B66B 5/02* (2006.01)
*B66B 11/04* (2006.01)

(52) U.S. Cl.
CPC ..... *B66B 5/027* (2013.01); *B66B 11/043* (2013.01); *B66B 11/0415* (2013.01)

(58) Field of Classification Search
CPC ... B66B 5/027; B66B 11/0415; B66B 11/043; B66B 7/068; B66B 17/12
See application file for complete search history.

(56) References Cited

U.S. PATENT DOCUMENTS

2002/0100645 A1* 8/2002 Bloch ..... B66B 5/027 187/311
2015/0166312 A1 6/2015 Ishikawa et al.

FOREIGN PATENT DOCUMENTS

| | | | |
|---|---|---|---|
| CN | 107986134 | A * | 5/2018 |
| CN | 110104527 | A * | 8/2019 |
| DE | 19851708 | A1 | 5/2000 |
| EP | 1142813 | A1 * | 10/2001 |
| JP | 2001097648 | A * | 4/2001 |

OTHER PUBLICATIONS

European Search Report for Application No. 21210852.6; dated Apr. 11, 2022; 8 Pages.

* cited by examiner

*Primary Examiner* — Diem M Tran
(74) *Attorney, Agent, or Firm* — Cantor Colburn LLP

(57) ABSTRACT

A force application assembly, an elevator and a method of elevator rescue. The force application assembly is provided for applying a force to an elevator car when the elevator car and a counterweight are in a balanced state, and the force application assembly includes: a first attachment portion, which is configured to be removably attached to an elevator hoistway; a second attachment portion, one end of which is removably fixed relative to the elevator car or the counterweight, and which is configured to be at least partially elastic; an actuation portion connected between the first attachment portion and the second attachment portion, wherein the first attachment portion is configured to be fixed relative to the actuation portion, and the second attachment portion is configured to be movable relative to the actuation portion; and an operation portion, which is associated with the actuation portion.

19 Claims, 2 Drawing Sheets

FORCE APPLICATION ASSEMBLY, ELEVATOR AND METHOD OF ELEVATOR RESCUE

FOREIGN PRIORITY

This application claims priority to Chinese Patent Application No. 202011370900.7, filed Nov. 30, 2020, and all the benefits accruing therefrom under 35 U.S.C. § 119, the contents of which in its entirety are herein incorporated by reference

Technical Field

The present application relates to the field of elevator auxiliary devices. More specifically, the present application relates to a force application assembly, which aims to enable an operator to remotely apply a force to an elevator car in a desired direction. The present application also relates to an elevator including the above force application assembly, and a method of elevator rescue.

BACKGROUND

The elevator may stop due to a failure during daily operation, and under the action of the load within an elevator car and a counterweight, the elevator car and the counterweight will remain in a balanced position. At this point, the operator needs to use a dedicated rescue device to apply a force to the car so that the car can leave its balanced position. Existing rescue devices are usually designed to be used in cooperation with a speed governor, and the speed governor is usually designed to be used with a closed loop cable or a steel wire rope. For example, the rescue device can apply a force onto the steel wire rope of the speed governor so as to move the car to a desired position, thereby implementing subsequent rescue operations.

SUMMARY

An object of one aspect of the present application is to provide a force application assembly, which aims to enable an operator to remotely apply a force to components of an elevator system. An object of another aspect of the present application is to provide an elevator including the above force application assembly. An object of a further aspect of the present application is to provide a method of elevator rescue.

The objects of the present application are achieved through the following technical solutions.

A force application assembly is provided for applying a force to an elevator car when the elevator car and a counterweight are in a balanced state, the force application assembly including:

a first attachment portion, which is configured to be removably attached to an elevator hoistway;

a second attachment portion, one end of which is removably fixed relative to the elevator car or the counterweight, and which is configured to be at least partially elastic; an actuation portion connected between the first attachment portion and the second attachment portion, wherein the first attachment portion is configured to be fixed relative to the actuation portion, and the second attachment portion is configured to be movable relative to the actuation portion; and an operation portion, which is associated with the actuation portion and is operable to move the second attachment portion away from or close to the actuation portion;

wherein the actuation portion applies a force to the second attachment portion, and the force is stored as elastic potential energy in the second attachment portion before the balanced state of the elevator car and the counterweight is broken.

In the force application assembly described above, optionally, the first attachment portion includes a hook so as to be removably attached to a fixing portion disposed in the elevator hoistway.

In the force application assembly described above, optionally, the fixing portion is disposed in one or more of the following positions: the bottom of the elevator hoistway, or any side wall of the elevator hoistway.

In the force application assembly described above, optionally, the fixing portion is correspondingly positioned directly under a compensation chain connection point on the elevator car, or positioned directly under a compensation chain connection point on the counterweight.

In the force application assembly described above, optionally, one end of the second attachment portion is removably attached to a compensation chain under the elevator car or under the counterweight.

In the force application assembly described above, optionally, the second attachment portion includes an elastic first part and a rigid second part, and the first part and the second part are connected together end-to-end in sequence.

In the force application assembly described above, optionally, the first part is removably attached to the compensation chain, and the second part is attached between the first part and the actuation portion.

In the force application assembly described above, optionally, the first part includes one or more of the following devices: a compression spring, a torsion spring, a tension spring, and an elastic piece.

In the force application assembly described above, optionally, the actuation portion is configured to convert the action of the operation portion into a pushing force or a pulling force applied to the second attachment portion in the length direction of the second attachment portion.

In the force application assembly described above, optionally, the actuation portion includes one or more of the following devices: a reversible chain mechanism, a pulley block, a lever mechanism, and a gear mechanism.

In the force application assembly described above, optionally, the reversible chain mechanism includes a hand chain block.

In the force application assembly described above, optionally, the operation portion includes one or more of the following devices: a chain, a rope, and a rod.

In the force application assembly described above, optionally, the chain is configured to have a closed shape, wherein the chain is engaged with the actuation portion at one end of the closed shape, and is operable at the other end of the closed shape; and wherein the chain is attached to a sprocket associated with the actuation portion.

In the force application assembly described above, optionally, the operation portion is sized in such a way that an operator can operate the operation portion when the operator is located outside the elevator hoistway.

In the force application assembly described above, optionally, the actuation portion includes an actuator for applying a force to the second attachment portion, and the operation portion includes a terminal for operating the actuator.

In the force application assembly described above, optionally, the actuator communicates with the terminal through one or more of the following methods: electric wire, wired network, Wi-Fi, Bluetooth, Zigbee, and telecommunication operator signal.

An elevator is provided, which includes the force application assembly described above.

A method of elevator rescue is provided for changing the position of an elevator car when the elevator car and a counterweight are in a balanced state, including the following steps: fixing the first attachment portion of the force application assembly relative to the elevator hoistway; fixing one end of the second attachment portion relative to the elevator car or the counterweight; applying a force to the second attachment portion through the actuation portion, so that the force is stored as elastic potential energy in the second attachment portion before the balanced state of the elevator car and the counterweight is broken; and changing the position of the elevator car by using the elastic potential energy stored in the second attachment portion.

In the method of elevator rescue described above, optionally, in the step of changing the position of the elevator car, the elastic potential energy is used to break a balanced force state of the elevator car by releasing an elevator brake device.

In the method of elevator rescue described above, optionally, the elevator brake device includes a tractor brake mechanism.

BRIEF DESCRIPTION OF THE DRAWINGS

The present application will be described below in further detail with reference to the accompanying drawings and preferred embodiments. Those skilled in the art will appreciate that these drawings are drawn only for the purpose of explaining the preferred embodiments and should not be construed as limiting the scope of the present application. In addition, unless specifically stated, the drawings are only intended to conceptually represent the composition or construction of the described objects and may contain exaggerated illustration. The drawings are not necessarily drawn to scale.

DETAILED DESCRIPTION

Figure 1:
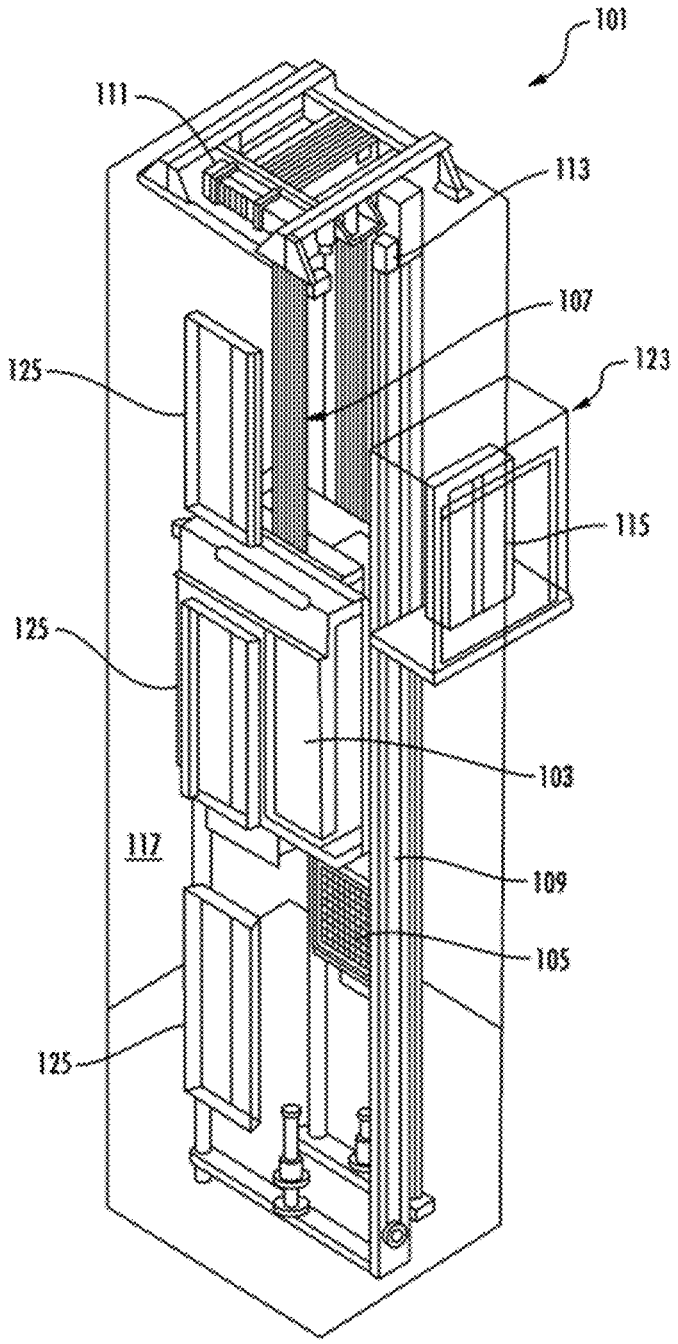
FIG. 1 is a schematic structural view of an embodiment of an elevator according to the present application.

Hereinafter, preferred embodiments of the present application will be described in detail with reference to the accompanying drawings. Those skilled in the art will appreciate that these descriptions are merely illustrative and exemplary, and should not be construed as limiting the scope of protection of the present application.

Firstly, it should be noted that the orientational terms such as top, bottom, upward, and downward mentioned herein are defined with respect to the directions in various drawings. These orientational terms are relative concepts, and therefore will vary with the position and state thereof. Accordingly, these or other orientational terms should not be interpreted as restrictive.

In addition, it should also be noted that for any single technical feature described or implied in the embodiments herein, or any single technical feature shown or implied in the drawings, it is still possible to combine these technical features (or their equivalents) so as to obtain other embodiments that are not directly mentioned herein.

It should be noted that in different drawings, identical or substantially identical components are denoted by identical reference signs.

FIG. 1 is a schematic structural view of an elevator. An elevator system 101 includes a series of parts installed in a hoistway 117 which may be arranged across multiple floors 125, and an elevator door may be respectively provided at each floor 125. The elevator system 101 includes: a car 103, a counterweight 105, a traction wire 107, a guide rail 109, a drive device 111, a position detection system 113, and a controller 115, etc. One end of the traction wire 107 is attached to the car 103, and the other end of the traction wire 107 is attached to the counterweight 105. The counterweight 105 is configured to balance the weight of the car 103, and the traction wire 107 moves under the driving of the drive device 111, so as to selectively change the position of the car 103 and make the car 103 stop at a desired floor. The traction wire 107 may be, for example, a rope, a steel cable, or a steel belt with a coating, and so on. The traction wire 107 may also include a pulley mechanism or a pulley block (not shown) to achieve desired raising and lowering operations. It is easy to understand that the car 103 is also correspondingly provided with a door for personnel to enter and exit the car 103.

The drive device 111 is provided at the top of the hoistway 117 and is configured to adjust the positions of the car 103 and the counterweight 105. The drive device 111 can be any suitable power supply device, including but not limited to an electric motor, etc. The drive device 111 may be powered by a power source line or power grid (not shown).

The position detection system 113 can be installed to be fixed relative to the hoistway 117, and is preferably arranged at the top of the hoistway 117; for example, it may be installed on a bracket or guide rail. The position detection system 113 is also configured to sense the position of the car 103 in the hoistway 117, so as to provide a position signal in relevant to the position of the car 103. In another embodiment, the position detection system 113 may also be arranged on other parts, such as on a moving part. The position detection system 113 may include an encoder, a sensor, or other suitable sensing systems, and the sensing method includes, but is not limited to, speed sensing, relative position sensing, absolute position sensing, digital encoding sensing, and so on.

The controller 115 may be arranged in an independent control room 123, or may also be arranged at other suitable positions. In an embodiment, the controller 115 may also be arranged at a remote location or in the cloud. The controller 115 is configured to control the operation of the entire elevator system 101. For example, the controller 115 can adjust the operation of the drive device 111 so as to make the car 103 and the counterweight 105 start, accelerate, decelerate, stop, etc. The controller 115 may perform control operations according to a signal from the position detection system 113. In an embodiment, the controller 115 is configured to stop the car 103 at one of the floors 125 and perform acceleration or deceleration movement between the floors 125.

Figure 2:
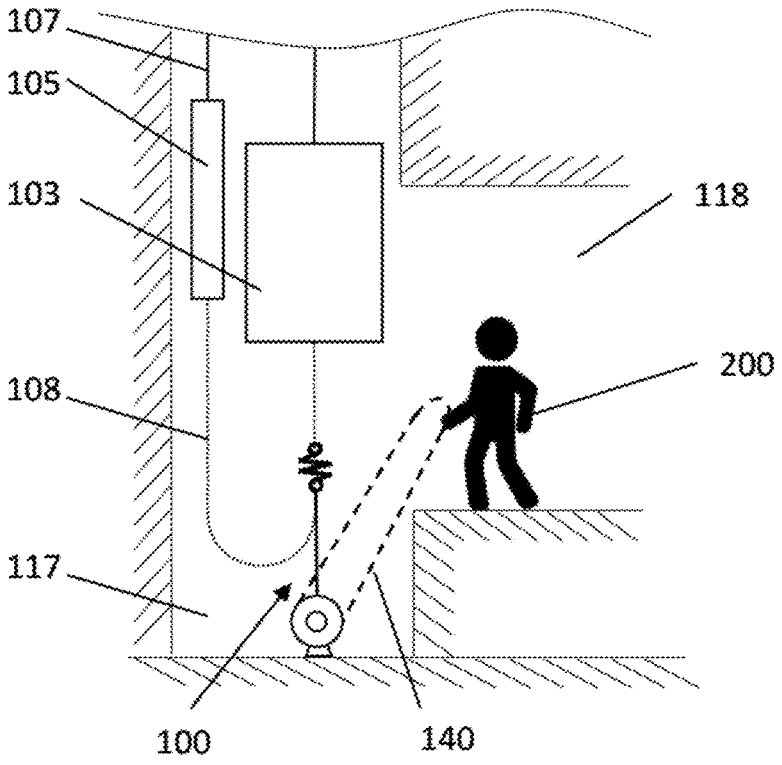
FIG. 2 is a schematic view of a force application assembly according to an embodiment of the present application during using.
Figure 3:
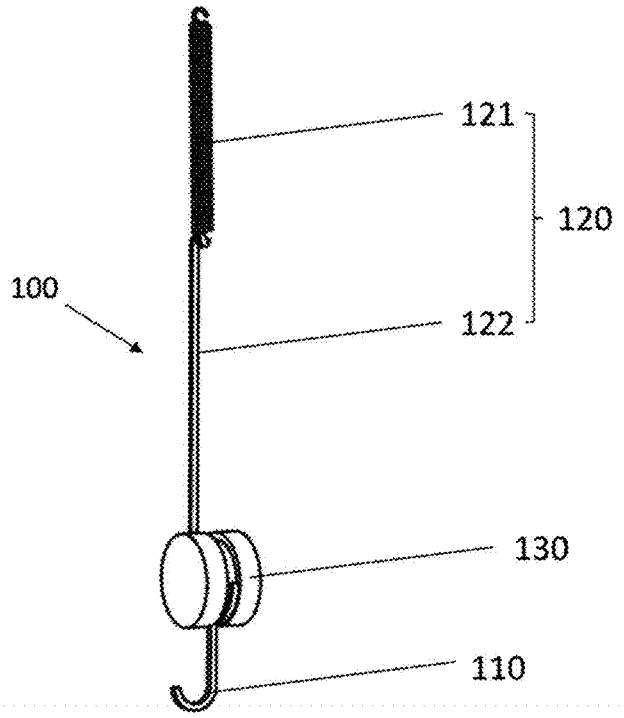
FIG. 3 is a perspective view of a part of a force application assembly according to an embodiment of the present application.

FIG. 2 is a schematic view of a force application assembly according to an embodiment of the present application during use, and FIG. 3 is a perspective view of a part of a force application assembly according to an embodiment of the present application. As shown in FIG. 2, when the elevator car and the counterweight are in a balanced state (for example, when the elevator stops due to a failure during operation), the car 103 and the counterweight 105 are operated by an elevator brake device (not shown) to stop inside the hoistway 117. For example, the elevator brake device may be a tractor brake mechanism. Top portions of the car 103 and the counterweight 105 may be connected by the traction wire 107, and bottom portions of the car 103 and the counterweight 105 may be connected by a compensation chain or a compensation rope 108 (shown in dotted lines). In the illustrated case, the position where the car 103 stops does not match with a space 118 to which the hoistway 117 is attached. The space 118 may be, for example, a hall which an elevator hall door faces, and so on. Therefore, in this case, it is impossible for a rescuer or an operator 200 to directly open the car door of the car 103 and perform the rescue operation.

As shown in FIGS. 2 and 3, a force application assembly 100 according to an embodiment of the present application includes: a first attachment portion 110, which is configured to be removably attached to the hoistway 117; a second attachment portion 120, one end of which is removably fixed relative to the elevator car 103, and which is configured to be at least partially elastic; an actuation portion 130 connected between the first attachment portion 110 and the second attachment portion 120, wherein the first attachment portion 110 is configured to be fixed relative to the actuation portion 130, and the second attachment portion 120 is configured to be movable relative to the actuation portion 130; and an operation portion 140 (shown in dashed lines), which is associated with the actuation portion 130 and is operable to move the second attachment portion 120 away from or close to the actuation portion 130.

As shown in FIG. 3, the first attachment portion 110 may include a hook so as to be removably attached to a fixing portion (not shown) provided in the hoistway 117. The fixing portion may be provided in one or more of the following positions: the bottom of the hoistway 117 and any side wall of the hoistway 117. In the embodiment shown in FIG. 2, the fixing portion is correspondingly positioned directly under a compensation chain connection point on the car 103.

As shown in FIG. 2, one end of the second attachment portion 120 is removably attached to the compensation chain 108 under the car 103. In another embodiment, the second attachment portion 120 may be removably attached to an attachment position on the car 103. In any case, the second attachment portion 120 is directly or indirectly attached to the car 103. As shown in FIG. 3, the second attachment portion 120 includes an elastic first part 121 and a rigid second part 122, and the first part 121 and the second part 122 are connected together end-to-end in sequence. The first part 121 is removably attached to the compensation chain 108, and the second part 122 is attached between the first part 121 and the actuation portion 130. The first part 121 and the second part 122 may be respectively provided with a hook at each end, so as to be removably attached together. In the embodiment shown in FIG. 3, the first part 121 is a spring. In another embodiment, the first part includes one or more of the following devices: a compression spring, a torsion spring, a tension spring, and an elastic piece.

The actuation portion 130 may be configured to apply a force to the second attachment portion 120, and the force is stored in the second attachment portion 120 as elastic potential energy before being transmitted to the car 103, that is, stored in the first part 121 with elasticity.

In the illustrated embodiment, the actuation portion 130 is configured to convert the action of the operation portion 140 into a pushing force or a pulling force applied to the second attachment portion 120 in the length direction of the second attachment portion 120. The actuation portion 130 may include one or more of the following devices: a reversible chain mechanism, a pulley block, a lever mechanism, and a gear mechanism. In an embodiment, the reversible chain mechanism includes a hand chain block, and the hand chain block may be installed invertedly. In another embodiment, the actuation portion 130 includes a series of pulley blocks, so as to change the direction and magnitude of the force from the operation portion 140.

The operation portion 140 may include one or more of the following devices: a chain, a rope, and a rod. In the illustrated embodiment, the operation portion 140 is a chain having a closed shape. The chain may be engaged with the actuation portion 130 at one end of the closed shape, and is operable at the other end of the closed shape. In an embodiment, the actuation portion 130 is associated with a sprocket (not shown), and the chain is joined on the sprocket. When one end of the chain is cyclically pulled by the operator, the other end of the chain will drive the sprocket to rotate and drive the actuation portion 130 associated with the sprocket. In an embodiment, the chain may be a hand chain block, or a hand-pulled chain with a reverse chain structure, and the movement of the chain is transmitted to the actuation portion 130 through the sprocket. The operation portion 140 may be sized in such a way that the operator can operate the operation portion 140 when the operator is located outside the hoistway 117. For example, in the illustrated embodiment, the length of the operation portion 140 is sized to be long enough to extend from the bottom of the hoistway 117 to the space 118 outside the hoistway 117, and may be operated by the operator 200 located in the space 118.

In use, the operator can apply a force to the actuation portion 130 through the chain 140 so that the actuation portion 130 applies a pulling force or a pushing force to the second attachment portion 120. These forces can be first stored in the elastic first part 121 in the form of elastic potential energy, and selectively transmitted to the car 103 to change the position of the car 103. Since the car 103 generally has a larger mass, changing its position requires a larger force or a larger energy consumption. The force application assembly described in the present application can selectively apply a force having a limited magnitude that the operator can exert by means of elastic potential energy, and can release the elastic potential energy accumulated in a period of time within a relatively short time. Therefore, a sufficient force is generated on the car 103 within a limited time, so as to change the position of the car 103. In the illustrated embodiment, the force applied by the operator to the second attachment portion 120 through the operation portion 140 tends to move the car 103 downward, with the purpose of lowering the car 103 to a suitable height for implementing subsequent rescue operations.

In another embodiment, the force application assembly 100 according to an embodiment of the present application may be installed under the counterweight 105. For example, the second attachment portion 120 may be attached to the compensation chain under the counterweight 105, and the first attachment portion 110 may be attached to the fixing portion under the counterweight 105. Correspondingly, the fixing portion may be located directly under the compensation chain connection point on the counterweight 105. In this case, the force applied to the second attachment portion 120 by the operator through the operation portion 140 tends to move the counterweight 105 downwardly. The counterweight 105 drives the car 103 to move upwardly, with the purpose of raising the car 103 to a suitable height for implementing subsequent rescue operations.

In another embodiment, the actuation portion 130 may include an actuator for applying a force to the second attachment portion 120, and the operation portion 140 includes a terminal for operating the actuator. The actuator may communicate with the terminal through one or more of the following methods: electric wire, wired network, Wi-Fi, Bluetooth, Zigbee, and telecommunication operator signal. In an embodiment, the actuator is an electric motor. In another embodiment, the terminal includes a mobile phone, a button, a notebook computer, etc.

In use, the operator can operate the actuator through the terminal, and the actuator can apply a force to the second attachment portion 120. In any case, the operator does not need to be inside the hoistway 117.

The present application also relates to an elevator, which includes the force application assembly described above.

The present application also relates to a method of elevator rescue, which is used to change the position of an elevator car when the elevator car and a counterweight are in a balanced state (for example, when the elevator stops due to a failure during operation). Specifically, the method of elevator rescue may include the following steps:

fixing the first attachment portion 110 of the force application assembly 100 described above relative to the hoistway 117;

fixing one end of the second attachment portion 120 relative to the car 103 or the counterweight 105;

applying a force to the second attachment portion 120 through the actuation portion 130, so that the force is stored as elastic potential energy in the second attachment portion 120 before the balanced state of the car and the counterweight is broken; and changing the position of the car 103 by using the elastic potential energy stored in the second attachment portion 120.

In an embodiment, the step of changing the position of the car may include using the elastic potential energy to break the balanced force state of the elevator car by releasing an elevator brake device. The elevator brake device may include, for example, a tractor brake mechanism. In another embodiment, the actuator 130 may periodically or non-uniformly apply force to the second attachment portion 120 so as to intermittently or continuously change the position of the car 103, thereby moving the car 103 to a suitable position. In an embodiment, the force application assembly 100 lowers the car 103 to a suitable position. In another embodiment, the force application assembly 100 raises the car 103 to a suitable position.

The force application assembly, the elevator, and the method of elevator rescue of the present application enable the operator to change the position of the elevator car through the force application assembly at a position outside the hoistway, thereby realizing safe and effective elevator rescue. The technical solutions of the present application have the advantages of being simple in structure, reliable in application, and easy to implement, etc.

The present application has been disclosed herein with reference to the accompanying drawings, and those skilled in the art are also enabled to implement the present application, including manufacturing and using any device or system, selecting suitable materials, and using any combined method. The scope of the present application is defined by the claimed technical solutions, and contains other examples that can be conceived by those skilled in the art. Such other examples should be considered as falling within the scope of protection determined by the technical solutions claimed in the present application, as long as such other examples include structural elements that are not different from the literal language of the claimed technical solutions, or such other examples include equivalent structural elements that are not substantively different from the literal language of the claimed technical solutions.

What is claimed is:

1. A force application assembly provided for applying a force to an elevator car when the elevator car and a counterweight are in a balanced state, the force application assembly comprising:

a first attachment portion, which is configured to be removably attached to an elevator hoistway;

a second attachment portion, one end of which is removably fixed relative to the elevator car or the counterweight, and which is configured to be at least partially elastic;

an actuation portion connected between the first attachment portion and the second attachment portion, wherein the first attachment portion is configured to be fixed relative to the actuation portion, and the second attachment portion is configured to be movable relative to the actuation portion; and an operation portion, which is associated with the actuation portion and is operable to move the second attachment portion away from or close to the actuation portion;

wherein the actuation portion applies a force to the second attachment portion, and the force is stored as elastic potential energy in the second attachment portion before the balanced state of the elevator car and the counterweight is broken;

wherein the operation portion is sized in such a way that an operator can operate the operation portion when the operator is located outside the elevator hoistway.

2. The force application assembly according to claim 1, wherein the first attachment portion comprises a hook, so as to be removably attached to a fixing portion disposed in the elevator hoistway.

3. The force application assembly according to claim 2, wherein the fixing portion is disposed in one or more of the following positions: the bottom of the elevator hoistway, or any side wall of the elevator hoistway.

4. The force application assembly according to claim 2, wherein the fixing portion is correspondingly positioned directly under a compensation chain connection point on the elevator car, or positioned directly under a compensation chain connection point on the counterweight.

5. The force application assembly according to claim 1, wherein one end of the second attachment portion is removably attached to a compensation chain under the elevator car or under the counterweight.

6. The force application assembly according to claim 5, wherein the second attachment portion comprises an elastic first part and a rigid second part, and the first part and the second part are connected together end-to-end in sequence.

7. The force application assembly according to claim 6, wherein the first part is removably attached to the compensation chain, and the second part is attached between the first part and the actuation portion.

8. The force application assembly according to claim 6, wherein the first part comprises one or more of the following devices: a compression spring, a torsion spring, a tension spring, and an elastic piece.

9. The force application assembly according to claim 1, wherein the actuation portion is configured to convert an action of the operation portion into a pushing force or a pulling force applied to the second attachment portion in the length direction of the second attachment portion.

10. The force application assembly according to claim 9, wherein the actuation portion comprises one or more of the following devices: a reversible chain mechanism, a pulley block, a lever mechanism, and a gear mechanism.

11. The force application assembly according to claim 10, wherein the reversible chain mechanism comprises a hand chain block.

12. The force application assembly according to claim 1, wherein the operation portion comprises one or more of the following devices: a chain, a rope, and a rod.

13. An elevator comprising the force application assembly according to claim 1.

14. A method of elevator rescue, which is used to change the position of an elevator car when the elevator car and a counterweight are in a balanced state, the method comprising the following steps:

fixing the first attachment portion of the force application assembly according to claim 1 relative to an elevator hoistway;

fixing one end of the second attachment portion relative to the elevator car or the counterweight;

applying a force to the second attachment portion through the actuation portion, so that the force is stored as elastic potential energy in the second attachment portion before the balanced state of the elevator car and the counterweight is broken; and changing the position of the elevator car by using the elastic potential energy stored in the second attachment portion.

15. The method of elevator rescue according to claim 14, wherein in the step of changing the position of the elevator car, the elastic potential energy is used to break the balanced force state of the elevator car by releasing an elevator brake device.

16. The method of elevator rescue according to claim 15, wherein the elevator brake device comprises a tractor brake mechanism.

17. A force application assembly provided for applying a force to an elevator car when the elevator car and a counterweight are in a balanced state, the force application assembly comprising:

a first attachment portion, which is configured to be removably attached to an elevator hoistway;

a second attachment portion, one end of which is removably fixed relative to the elevator car or the counterweight, and which is configured to be at least partially elastic;

an actuation portion connected between the first attachment portion and the second attachment portion, wherein the first attachment portion is configured to be fixed relative to the actuation portion, and the second attachment portion is configured to be movable relative to the actuation portion; and an operation portion, which is associated with the actuation portion and is operable to move the second attachment portion away from or close to the actuation portion;

wherein the actuation portion applies a force to the second attachment portion, and the force is stored as elastic potential energy in the second attachment portion before the balanced state of the elevator car and the counterweight is broken;

wherein the operation portion comprises a chain;

wherein the chain is configured to have a closed shape, the chain is engaged with the actuation portion at one end of the closed shape, and is operable at the other end of the closed shape; and wherein the chain is attached to a sprocket associated with the actuation portion.

18. The force application assembly according to claim 1, wherein the actuation portion comprises an actuator for applying a force to the second attachment portion, and the operation portion comprises a terminal for operating the actuator.

19. A force application assembly provided for applying a force to an elevator car when the elevator car and a counterweight are in a balanced state, the force application assembly comprising:

a first attachment portion, which is configured to be removably attached to an elevator hoistway;

a second attachment portion, one end of which is removably fixed relative to the elevator car or the counterweight, and which is configured to be at least partially elastic;

an actuation portion connected between the first attachment portion and the second attachment portion, wherein the first attachment portion is configured to be fixed relative to the actuation portion, and the second attachment portion is configured to be movable relative to the actuation portion; and an operation portion, which is associated with the actuation portion and is operable to move the second attachment portion away from or close to the actuation portion;

wherein the actuation portion applies a force to the second attachment portion, and the force is stored as elastic potential energy in the second attachment portion before the balanced state of the elevator car and the counterweight is broken;

wherein the actuation portion comprises an actuator for applying a force to the second attachment portion, and the operation portion comprises a terminal for operating the actuator;

wherein the actuator communicates with the terminal through one or more of the following methods: electric wire, wired network, Wi-Fi, Bluetooth, Zigbee, and telecommunication operator signal.

* * * * *